United States Patent [19]

Gallant

[11] Patent Number: 4,998,732

[45] Date of Patent: Mar. 12, 1991

[54] GOLF TEE

[76] Inventor: Thomas M. Gallant, 333 N. Vermont, Glendora, Calif. 91740

[21] Appl. No.: 436,681

[22] Filed: Nov. 15, 1989

[51] Int. Cl.[5] ..... A63B 57/00

[52] U.S. Cl. ..... 273/212; 273/207

[58] Field of Search ..... 273/33, 202-212

[56] References Cited

U.S. PATENT DOCUMENTS

| | | | |
|---|---|---|---|
| 1,623,119 | 4/1927 | Kerney | 273/203 |
| 1,679,579 | 8/1928 | Lundy | 273/207 |
| 2,589,763 | 3/1952 | Barrett | 273/203 |
| 2,839,304 | 6/1958 | Lerick | 273/207 |
| 3,506,263 | 4/1970 | Arrington | 273/33 |
| 3,645,537 | 2/1927 | Parenteau | 273/207 |

FOREIGN PATENT DOCUMENTS

| | | | |
|---|---|---|---|
| 20690 | of 1914 | United Kingdom | 273/207 |
| 238599 | 8/1925 | United Kingdom | 273/212 |
| 109972 | 3/1940 | United Kingdom | 273/207 |

*Primary Examiner*—Theatrice Brown

[57] ABSTRACT

The invention relates to a golf tee assembled formed of a flexible rubber ball support shaft, an aluminum or plastic ground engaging spike and an aluminum retainer ring. The support shaft and spike each are provided with complementary planar flange and disc, respectively. The retainer ring is cup shaped and has a central bore. The central bore is made a size to receive the support shaft so the retainer ring can be moved to the flange and disk. The retainer ring has a shape which conforms to the shape of the flange. The planar surfaces of the flange and disc engage in abutting relationship and the retainer ring is crimped or folded around the flange and disc to thereby rigidly connect the support shaft and ground engaging spike to form a one piece golf tee unit.

6 Claims, 2 Drawing Sheets

GOLF TEE

BACKGROUND OF THE INVENTION

1. Field of the Invention

This invention relates to golf tees. The purpose of a golf tee is to support the golf ball so contact can be made with the iron or wood/metal club head face.

2. Description of the Prior Art

Previously golf tees have either been formed of wood, which is susceptible to chipping and breakage, or have been molded out of plastic to form a hard strong product which tends to deform and bend with impact of the club head making it difficult, once deformed, to straighten and insert into the ground.

Both the wooden and plastic tees are very apt to be driven out of the ground and lost. When inserting the wood and plastic tees it is difficult to maintain a constant height of the tee above the ground. This causes the golfer to repeatabily bend over to readjust the height the tee is projecting above the ground. This inability to maintain a constant tee height, above the ground, results in the golf ball being projected, by the force of the club head, from the tee in varying directions, projectiles and distances.

When inserting wood or plastic tees, into the ground, more effort is required to reach and maintain the desired height of the tee above the ground. In addition, a great number of tees are being left in and on the fairway due to the difficulty required to grasp the tip of the tee and apply enough upward force to remove the tee and/or cause breakage of the tee, making it very difficult to retrieve and/or reuse.

SUMMARY

The objects, of this invention, are to provide a tee that can be reused over and over again without breaking; to provide a constant mounting height of the golf ball above the ground (resulting in greater accuracy of flight, greater distance traveled and reduced chance of topping the golf ball) not having to repeatedly bend over to readjust the tee height, above the ground, and to provide a safe and easy way to both insert and remove the tee from the Fairway Tee Area.

A permanent tee for all golfers comprising a, one piece, thin tapering vertical rubber shaft tube having a top ball-receiving recess; a thin tapering horizontal rubber disc support base; an inverted aluminum retainer ring; and a one piece cylindrical horizontal metal or plastic disc and cylindrical metal or plastic ground spike; the disc being secured to the rubber shaft unit by the aluminum retainer ring, upon crimping, into one integral assembly.

The shaft being flexible and of rubber will not break; the retainer ring being rigid and of metal will not break or crack; the disc being rigid and of metal or plastic will not easily break or crack; the rubber base compressed by the disc and retainer ring will bend readily when the rubber shaft supporting, a golf ball, is struck by a club head and will resume its normal shape and whereby the tee base is permanent and will retain its position after impact.

DESCRIPTION OF THE PREFERRED EMBODIMENTS

Figure 2:
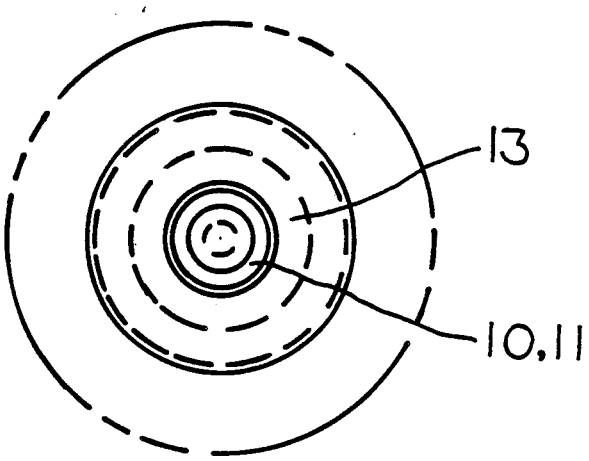
FIG. 2 is a top view of my invention.
Figure 1:
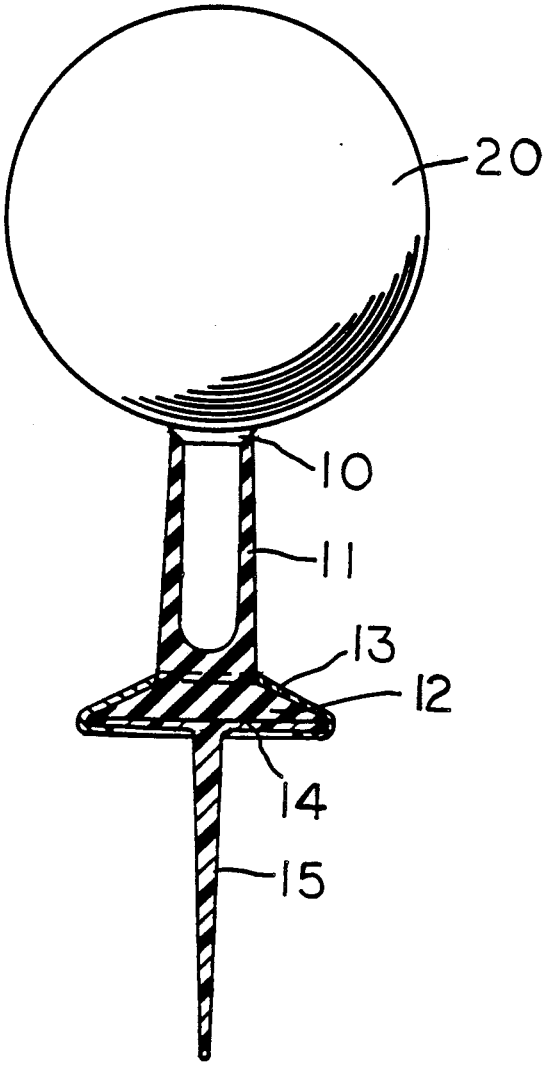
FIG. 1 is a side assembly cross section.
Figure 4:
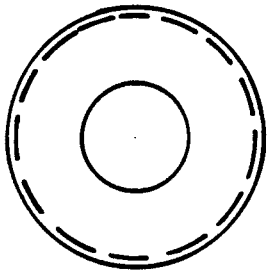
FIG. 4 is a top view of the aluminum retainer ring.
Figure 3:
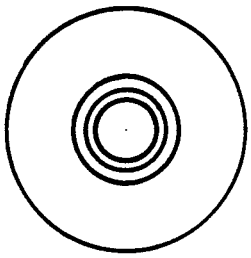
FIG. 3 is a top view of the rubber shaft/base unit.
Figure 7:
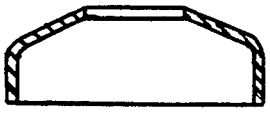
FIG. 7 is a side section of FIG. 4.
Figure 6:
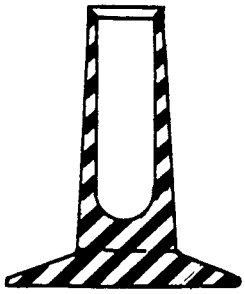
FIG. 6 is a side section of FIG. 3.
Figure 5:
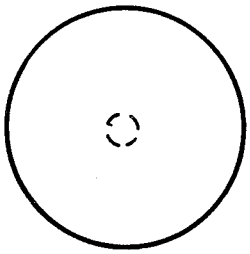
FIG. 5 is a top view of the metal or plastic ground spike retainer washer unit.
Figure 8:
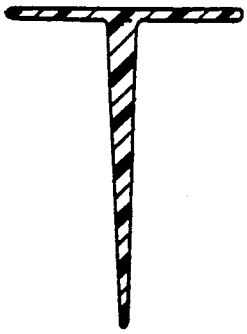
FIG. 8 is a side section of FIG. 5.

Referring to FIGS. 1 & 3, the tee is comprised a one piece hollow rubber ball support shaft 11 having a tapered ball support recess 10 at one end thereof. The other end of the shaft 11 is provided with an outwardly extending base flange 12, the flange being integral with the shaft 11 to form a one-piece structure. The flange 12 had a taper which extends downwards and away from shaft 11 and has a planar bottom surface. The tee further has an elongated plastic or aluminum ground engaging spike 15 (FIG. 8). The spike has one of its ends terminating in a point for engaging and extending into a golf course surface. The other end of the spike terminates in a planar disk 14. The planar disk 14 has planar dimensions substantially equal to the planar bottom surface of the shaft base flange 12. An aluminum retainer ring 13 (FIG. 7) is provided for attaching the shaft base flange 12 to the spike planar disk 14. The retainer ring 13 is cup shaped and having a central bore therein. The bore shape is complementary to the shape of the shaft and has a size dimension slightly larger than the transverse dimension of the shaft 11, but less than the planer dimension of the base flange 12. The shape of the retainer ring 13 is complementary to the shape of the base flange 12.

The tee is assembled as follows. The planar bottom of the base flange 12 and the planar disk 14 of the spike 15 are placed in abutting engagement as shown in FIG. 1. The shaft 11 is extended through the central bore of the retainer ring and the retainer ring is moved into abutting engagement with the flange 12. The rim of the retainer ring is made to extend beyond the edges of the flange 12 and planar disk 14 a predetermined distance and substantially parallel to the shaft 15. The assembled support shaft 11, spike 15, and retainer ring 13 are placed in a die which folds a portion of the retainer ring around the edges of the flange and disk to thereby rigidly connect the support shaft to the ground engaging spike to form a one piece golf tee unit as shown in FIG. 1.

I claim:

1. A golf tee for supporting a golf ball at a predetermined height above a playing surface comprising, a vertically tapering extending cylindrical ball support shaft having a ball support recess at its upper end and an outwardly and downwardly extending flange at its lower end, said flange having a planar lower surface, an elongated ground engaging spike having a lower pointed end for penetrating a playing surface and a planar disc shaped member attached to its upper end. A retainer ring, said retainer ring having a central opening wherein, said shaft being coaxially received in said opening such that said retainer ring rests against said flange at said shaft lower end, said retainer ring conforming to said flange and having a portion extending outwardly beyond the peripheral edge of said flange and conforming, to the outwardly and downwardly configuration of said flange, said planar lower surface and a surface of said planar disc being engaged along a planar surface such that said ground engaging spike is coaxial with said ball support shaft, said extending portion of said retainer ring being folded around the edges of said flange and said disc shaped member to thereby rigidly connect said support shaft to said ground engaging spike.

2. A golf tee as defined in claim 1 wherein, said support shaft is a one piece resilient member.

3. A golf tee as defined in claim 1 wherein, said ground engaging spike and planar disk is metal or plastic.

4. A golf tee as defined in claim 2 wherein, said resilient material is rubber.

5. A golf tee as defined in claim 3 wherein, said metal is aluminum or steel.

6. A golf tee as defined in claim 4 wherein, said plastic is rigid PVC or ABS.

* * * * *